US005356858A

United States Patent [19]

Yabuta et al.

[11] Patent Number: 5,356,858

[45] Date of Patent: Oct. 18, 1994

[54] RECEIVING SHEET FOR SUBLIMATION TYPE HEAT TRANSFER RECORDING

[75] Inventors: Kenji Yabuta; Hideki Sekiguchi, both of Tokyo, Japan

[73] Assignee: Mitsubishi Paper Mills Limited, Tokyo, Japan

[21] Appl. No.: 75,094

[22] Filed: Jun. 11, 1993

Related U.S. Application Data

[62] Division of Ser. No. 704,044, May 22, 1991, abandoned.

[30] Foreign Application Priority Data

May 28, 1990 [JP] Japan ..... 2-138959
Jun. 4, 1990 [JP] Japan ..... 2-146683

[51] Int. Cl.[5] ..... B41M 5/035; B41M 5/38

[52] U.S. Cl. ..... 503/227; 427/146; 428/195; 428/913; 428/914

[58] Field of Search ..... 8/471; 428/195, 212, 428/913, 914; 503/227; 427/146

[56] References Cited

U.S. PATENT DOCUMENTS 4,837,200 6/1989 Kondo et al. ..... 503/227
5,236,886 8/1993 Tsuchiya et al. ..... 503/227

FOREIGN PATENT DOCUMENTS 0409515 1/1991 European Pat. Off. ..... 503/227

*Primary Examiner*—B. Hamilton Hess
*Attorney, Agent, or Firm*—Cushman, Darby & Cushman

[57] ABSTRACT

There are disclosed a receiving sheet for sublimation type heat transfer recording comprising a substrate, an intermediate layer formed on the substrate, and an ink-receiving layer formed on the intermediate layer, said intermediate layer comprising a cured resin, and said ink-receiving layer comprising a thermoplastic resin; and a process for producing said receiving sheet. When said receiving sheet is used, the heat shrinkage of the substrate and blocking can be prevented and an image having a high coloring density can be obtained.

4 Claims, No Drawings

RECEIVING SHEET FOR SUBLIMATION TYPE HEAT TRANSFER RECORDING

This application is a division of Ser. No. 07/704,044 filed May 22, 1991, now abandoned.

The present invention relates to a receiving sheet for sublimation type heat transfer recording comprising a support having a high surface smoothness (e.g. coated paper, laminated paper, or synthetic paper), an intermediate layer formed on the support and an ink-receiving layer formed on the intermediate layer. More particularly, it relates to a receiving sheet for sublimation type heat transfer recording which has a high blocking resistance and can give an image having a high quality and a high coloring density.

In recent years, sublimation type heat transfer printers using sublimable ink have been used as a means for making color hard copies, particularly for reproducing a multicolor gradutional image. The principle of such heat transfer printer is as follows. An image is converted into an electric signal, which is then converted into heat by means of a thermal head to heat a sheet coated with sublimable ink (an ink donor sheet) to cause sublimation of the ink. The ink thus sublimed is fixed on a receiving sheet which is brought into contact with the ink donor sheet, whereby the image is reproduced. In general, the surface of such a receiving sheet has an ink-receiving layer formed of a polymer such as polyester or polyacetate.

In recent years, there has been a demand for increase of the printing speed and improvement of the quality of transferred image in heat transfer type printers using sublimable ink. When a porous substrate such as ordinary paper is employed as a substrate for a receiving sheet for sublimation type heat transfer recording, it does not have a sufficient smoothness and hence gives a low quality of image. For improving the quality of transferred image, a substrate having smooth surface has to be used, for example, coated papers such as art paper and coat paper; films of synthetic resins such as polyethylene, polypropylene, polyethylene terephthalate and polyamide; and papers laminated on one side or both sides with these synthetic resins; and synthetic papers. Because of their low heat resistance and high surface smoothness, a sheet of these materials causes shrinkage by heat on the surface and forms into a block with an ink donor sheet (blocking), resulting in a deteriorated quality of image. Increase in the printing speed inevitably leads to increase in the thermal printing temperature and hence tends to make such conditions worse. As a means for solving such problems, there is known a receiving sheet for sublimation type heat transfer recording obtained by coating an addition-polymerizable oligomer on a substrate and subjecting the same to a radiation for crosslinking (Jap. Pat. Appln. Kokai (Laid-Open) 62-173295. Practical use of such a receiving sheet for heat transfer recording, however, involves the following problem. The receiving sheet is desired to have certain cushoning properties for promoting the adhesion between it and an ink donor sheet during printing. But, when the addition-polymerizable composition is cured, the cured product is poor in cushioning properties. Moreover, in general, such an addition-polymerizable composition is hard to be dyed by a sublimable ink. Therefore, while this means eliminates blocking, an image of high quality and having a high image density can hardly be obtained.

The present inventors earnestly investigated in order to solve such problems. Consequently, it was found that a receiving sheet for sublimation type heat transfer recording which can develop an image of a high quality, having high coloring density and is free from blocking, can be obtained by providing on a substrate an intermediate layer comprising an addition-polymerizable resin and curing it and by further providing thereon an ink-receiving layer formed of a thermoplastic resin which is easily dyed by a sublimation dye.

According to the present invention, there are provided a receiving sheet for sublimation type heat transfer recording comprising a substrate, an intermediate layer formed on the substrate and an ink-receiving layer formed on the intermediate layer, said intermediate layer comprising a cured resin, and said ink-receiving layer comprising a thermoplastic resin; and a process for producing said receiving sheet.

The present invention is illustrated below in detail.

The receiving sheet for heat transfer recording of the present invention comprises a substrate, an intermediate layer formed on the substrate and an ink-receiving layer formed on the intermediate layer.

The ink-receiving layer comprises a thermoplastic resin as its essential constituent preferably in an amount of 40 to 90% by weight based on the weight of the ink-receiving layer. More preferably, it further comprises a cured resin in an amount of 60 to 10% by weight based on the weight of the ink-receiving layer.

The ink-receiving layer is formed in an amount of preferably 1–15 g/m$^2$, more preferably 3–8 g/m$^2$.

As the thermoplastic resin, there can be used, for example, those having ester bonds (e.g. polyester resins, polyacrylic ester resins, polycarbonate resins, polyvinyl acetate resins, and styrene acrylate resins), those having urethane bonds (e.g. polyurethane resins), and those having amide bonds (e.g. polyamide resins (nylons)). There can also be used copolymers comprising as its main constituent at least one kind of constituent unit selected from the constituent units of the above resins, for example, vinyl chloride-vinyl acetate copolymers and styrene-butadiene copolymers. In addition, the resins exemplified above can be used singly or as a mixture thereof.

Although all of the above-exemplified thermoplastic resins can be suitably used, polyester resins are particularly preferable for improving the dyability by sublimable dyes and for developing an image of high density.

When the content of the thermoplastic resin represented by polyester resins is less than 40% by weight, the coloring density of image is lowered in some cases. When it is more than 90% by weight, blocking is caused between the receiving sheet and an ink donor sheet in some cases, resulting in a deteriorated quality of image.

The above-exemplified thermoplastic resins can be coated on the intermediate layer in the form of either a solution prepared by dissolving them preferably together with an addition-polymerizable substance in an organic solvent, or an emulsion prepared by emulsifying them preferably together with an additional-polymerizable substance in an aqueous solution.

If necessary, the ink-receiving layer may contain additives such as dyes, pigments, wetting agents, defoaming agents, dispersing agents, antistatic agents, mold releasing agents, optical whitening agents, etc.

When particles of inorganic materials represented by silica, calcium carbonate, kaolin, clay, barium sulfate, titanium oxide, etc. are used as pigments, blocking can be more effectively prevented.

Mold releasing agents can be sued for the same purpose as described above. Specific examples thereof are solid waxes such as polyethylene was, amide wax, Teflon powder, etc., surfactants of fluorine type or phosphoric acid ester type, and silicon compounds. Of these cure-type silicon compounds are preferably used because they hardly cause bleeding or transfer of a transferred dye or a lowering of the coloring density. The cure-type silicon compounds include reaction-cure type silicon compounds, radiation-cure type silicon compounds, catalyst-cure type silicon compounds, etc. When irradiation with ultraviolet rays or an electron beam is conducted after forming the ink-receiving layer, the radiation-cure type silicon compounds are advantageously used.

The hardened resin preferably contained in the ink-receiving layer is produced typically by coating an addition-polymerizable compound on the intermediate layer as it is or in the form of a solution in a suitable solvent, optionally together with an initiator, and irradiating the resulting coating with radiation such as ultraviolet rays or an electron beam.

As the addition-polymerizable compound, there are preferably used those having a reactive group such as acryloyl group, methacrylic group or epoxy group at the end or in the side chain of the molecule. There can be used, for example, unsaturated polyesters, modified unsaturated polyesters, acrylic polymers, acrylic monomers, methacrylic polymers, methacrylic monomers, monomers or oligomers which have an ethylenically unsaturated bond, and epoxy compounds, singly or in combination. Typical examples of the addition-polymerizable compound are given below.

(a) Polyester acrylates and polyester methacrylates

Aronix M-5300, Aronix M-5400, Aronix M-5500, Aronix M-5600, Aronix M-5700, Aronix M-6100, Aronix M-6200, Aronix M-6300, Aronix M-6500, Aronix M-7100, Aronix M-8030, Aronix M-8060 and Aronix M-8100 (trade names, Toagosei Chemical Industry Co., Ltd.), Biscoat 700 and Biscoat 3700 (trade names, Osaka Organic Chemical Industry Ltd.), Kayarad HX-220 and Kayarad HX-620 (trade names, Nippon Kayaku Kabushikikaisha).

(b) Epoxyacrylates and epoxymethacrylates

NK ester EA-800 and NK ester EPM-800 (trade names, Shinnakamura Kagaku K.K.), Biscoat 600 and Biscoat 540 (trade names, Osaka Organic Chemical Industry Ltd.), Photomer 3016 and Photomer 3082 (trade names, Sunnopco Co., Ltd.).

(c) Urethane acrylates and urethane methacrylates

Aronix M-1100, Aronix M-1200, Aronix M-1210, Aronix M-1250, Aronix M-1260, Aronix M-1300 and Aronix M-1310 (trade names, Toagosei Chemical Industry Co., Ltd.), Biscoat 812, Biscoat 823 (trade names, Osaka Organic Chemical Industry Ltd.), NK ester U-108-A and NK ester U-4HA (trade names, Shinnakamura Kagaku K.K.).

(d) Monofunctional acrylates and monofunctional methacrylates

Methyl acrylate, ethyl acrylate, butyl acrylate, 2-ethylhexyl acrylate, 2-hydroxyethyl acrylate, 2-hydroxyethyl methacrylate, 2-hydroxypropyl acrylate, tetrahydrofurfuryl acrylate, phenoxyethyl acrylate, cyclohexyl acrylate, cyclohexyl methacrylate, benzyl acrylate, glycidyl methacrylate, N,N-dimethylaminoethyl acrylate, N,N-dimethylaminoethyl methacrylate, N,N-diethylaminoethyl methacrylate, butoxyethyl acrylate, ethylene-oxide-modified phenoxylated phosphoric acid acrylate, ethylene-oxide-modified butoxylated phosphoric acid acrylate, and other monofunctional acrylates and methacrylates manufactured by Toagosei Chemical Industry Co., Ltd. having trade names of Aronix M-101, Aronix M-102, Aronix M-111, Aronix M-113, Aronix M-114, Aronix M-117, Aronix M-152, Aronix M-154, etc.

(e) Polyfunctional acrylates and polyfunctional methacrylates 1,6-Hexanediol diacrylate, 1,6-hexanediol dimethacrylate, neopentyl glycol diacrylate, diethylene glycol diacrylate, polyethylene glycol diacrylate, polyethylene glycol dimethacrylate, polypropylene glycol diacrylate, polypropylene glycol dimethacrylate, pentaerythritol diacrylate, dipentaerythritol hexaacrylate, isocyanauric acid diacrylate, pentaerythritol triacrylate, isocyanuric acid triacrylate, trimethylolpropane triacrylate, trimethylolpropane trimethacrylate, ethylene-oxide-modified pentaerythritol tetraacrylate, propylene-oxide-modified pentaerythritol tetraacrylate, propylene-oxide-modified dipentaerythritol polyacrylate, ethylene-oxide-modified pentaerythritol polyacrylate, and other polyfunctional acrylates and methacrylates manufactured by Toagosei Chemical Industry Co., Ltd. having trade names of Aronix M-210, Aronix M-215, Aronix M-220, Aronix M-230, Aronix M-233, Aronix M-240, Aronix M-245, Aronix M-305, Aronix M-309, Aronix M-310, Aronix M-315, Aronix M-320, Aronix M-325, Aronix M-330, Aronix M-400, T0-458, T0-747, T0-755, THIC. TA2, etc.

(f) Epoxy compounds

Glycidyl methacrylate, 1,3-bis(N,N-diepoxypropylaminomethyl)cyclohexane, 1,3-bis(N,N-diepoxypropylaminomethyl)benzene, and other epoxy compounds manufactured by Mitsubishi Gas Chemical Co., Ltd. having trade names of GE-510, TETRAD-X, TETRAD-C, etc.

A photoinitiator used in the present invention includes acetophenones such as di- and trichloroacetophenone, benzophenone, Michler's ketone, benzyl, benzoin, benzoin alkyl ethers, benzyl dimethyl ketal, tetramethylthiuram monosulfide, thioxanthones, azo compounds, etc. The photoinitiator is selected from them from the viewpoint of the type of polymerization reaction of the addition-polymerizable compound, its stability, its suitability to an irradiation apparatus, and the like. The amount of the photoinitiator used is usually 1 to 5% based on the weight of the addition-polymerizable compound. A storage stabilizer such as hydroquinone is used together with the photoinitiator in some cases.

On the other hand, the intermediate layer comprises a cured resin. The intermediate layer can be formed in the same manner as for the ink-receiving layer by using the same addition-polymerizable compounds and optionally initiators and additives as exemplified in the case of formation of the ink-receiving layer.

The intermediate layer is formed in an amount of preferably 1 to 20 $g/m^2$, more preferably 2 to 10 $g/m^2$, most preferably 2 to 5 $g/m^2$.

The substrate used in the present invention preferably has a high degree of smoothness, that is, its Bekk smoothness is preferably 1000 seconds or more as measured in accordance with JIS P8119.

Specifically, there can be used, for example, coated papers such as art paper, coat paper, etc.; films of synthetic resins such as polyethylene, polypropylene, polyethylene terephthalate, polyamide, etc.; laminated papers obtained by laminating these synthetic resins on one side or both side of paper; and synthetic papers.

As a method for forming each of the intermediate layer and the ink-receiving layer on the substrate, there can be employed, for example, blade coating, air doctor coating, squeeze coating, air knife coating, reverse-roll coating, gravure coating, transfer roll coating, bar coating, and curtain coating.

If necessary, it is also possible to form the intermediate layer on the substrate, attach a highly smooth film to the intermediate layer, irradiate the intermediate layer with radiation from the film side to harden the same, peel off the film, and form the ink-receiving layer on the cured intermediate layer.

As the radiation for curing the addition-polymerizable compound, there can generally be exemplified ultraviolet rays, α-rays, β-rays, γ-rays, X-rays and electron beam. But, α-rays, β-rays, γ-rays and X-rays involve the problem of danger to human body, and therefore it is advantageous to use ultraviolet rays or an electron beam which are easy to handle and have industrially come into wide use.

When an electron beam is used, the irradiation dose thereof is preferably approximately 0.1–10 Mrad. When it is less than 0.1 Mrad, no sufficient effect of the irradiation can be obtained. When it is more than 10 Mrad, a paper or film substrate is deteriorated. Therefore, such irradiation doses out of the range are not desirable.

As a method for the irradiation with an electron beam, a scanning method, a curtain beam method, etc. can be employed. A suitable accelerating voltage for the electron beam irradiation is approximately 100–300 KV.

When ultraviolet rays are used, it is necessary to incorporate a photoinitiator into an addition-polymerizable composition. As the photoinitiator, those exemplified above can be properly used.

As a light source for the irradiation with ultraviolet rays, there can be suitably used, for example, a low-pressure mercury lamp, moderate-pressure mercury lamp, high-pressure mercury lamp, xenon lamp, and tungsten lamp.

The addition-polymerizable compound can be cured in any step in the process for producing the receiving sheet. For example, it can be cured in a step subsequent to the formation of the intermediate layer on the substrate and/or a step subsequent to the formation of the ink-receiving layer on the intermediate layer.

As described above, in the receiving sheet of the present invention, the intermediate layer and preferably the ink-receiving layer comprise a cured resin. Therefore, the heat shrinkage of the substrate and blocking during heat transfer recording can be prevented, and an image having a high quality and a high coloring density can be formed on the receiving sheet.

The present invention is further illustrated with the following examples, which should not be construed as limiting the scope of the invention.

EXAMPLE 1

An addition-polymerizable composition according to the recipe shown below was coated in an amount of 5.0 g/m$^2$ on a photographic support (a so-called resin coated paper) obtained by laminating a polyethylene on paper, and cured by ultraviolet irradiation (three 80 W lamps). Then, a polyester resin emulsion (Vylonal MD-1330, Toyobo Co., Ltd.) was coated on the cured composition in an amount of 3.0 g/m$^2$ in terms of dry solids with an air knife coater and dried, whereby a receiving sheet for heat transfer recording was obtained.

| Addition-polymerizable composition | |
|---|---|
| Acrylic monomer M-220 (mfd. by Toagosei Chemical Industry Co., Ltd.) | 98 parts |
| Benzyldimethyl ketal IRGACURE 951 (mfd. by Ciba-Geigy Co.) | 2 parts |

EXAMPLE 2

An addition-polymerizable composition according to the recipe shown below was coated on coat paper in an amount of 3.0 g/m$^2$ with an offset gravure coater and cured by irradiation with an electron beam (accelerating voltage: 175 KV, irradiation dose: 1 Mrad). Then, a mixture of a polyester resin emulsion (Vylonal MD-1330, Toyobo Co., Ltd.) and silica was coated on the cured composition with an air knife coater to adjust the amounts of the emulsion and silica coated to 3.0 g/m$^2$ and 0.5 g/m$^2$, respectively, in terms of dry solids, and dried, whereby a receiving sheet for heat transfer recording was obtained,

| Addition-polymerizable composition | |
|---|---|
| Acrylic oligomer TC-120S (mfd. by Nippon Kayaku Kabushikikaisha) | 50 parts |
| Acrylic monomer M-210 (mfd. by Toagosei Chemical Industry Co., Ltd.) | 50 parts |

EXAMPLE 3

An addition-polymerizable composition according to the recipe shown below was coated on a synthetic paper (Yupo FPG-110, Oji Yuka Co., Ltd.) in an amount of 2.5 g/m$^2$ with an offset gravure coater and hardened by irradiation with an electron beam (accelerating voltage: 150 KV, irradiation dose: 1.5 Mrad). Then, a mixture of a polyester resin emulsion (Vylonal MD-1930, Toyobo Co., Ltd.) and silica was coated on the cured composition with an air knife coater to adjust the amounts of the emulsion and silica coated to 2.5 g/m$^2$ and 0.3 g/m$^2$, respectively in terms of dry solids, and dried, whereby a receiving sheet for heat transfer recording was obtained.

| Addition-polymerizable composition | |
|---|---|
| Acrylic oligomer M-210 (mfd. by Toagosei Chemical Industry Co., Ltd.) | 95 parts |
| Syloid 162 (mfd. by Fuji Devison Co., Ltd.) | 5 parts |

EXAMPLE 4

An addition-polymerizable composition according to the recipe shown below was coated on art paper in an amount of 3.0 g/m$^2$ with an offset gravure coater, and a polyester film was laid on the coated surface. The composition was cured by irradiation with an electron beam (accelerating voltage: 200 KV, irradiation dose: 1.5

Mrad), after which the polyester film was peeled off. Then a mixture of a polyester resin emulsion (Vylonal MD-1330, Toyobo Co., Ltd.) and silica was coated on the cured composition with an air knife coater to adjust the amount of the emulsion and silica coated to 3.0 g/m$^2$ and 0.5 g/m$^2$, respectively in terms of dry solids, and dried, whereby a receiving sheet for heat transfer recording was obtained.

| Addition-polymerizable composition | |
|---|---|
| Acrylic oligomer TC-120S (mfd. by Nippon Kayaku Kabushikikaisha) | 50 parts |
| Acrylic monomer M-210 (mfd. by Toagosei Chemical Industry Co., Ltd.) | 45 parts |
| Syloid 162 (mfd. by Fuji Devison Co., Ltd.) | 5 parts |

Comparative Example 1

A mixture of a polyester resin emulsion (Vylonal MD-1330, Toyobo Co., Ltd.) and silica was coated directly on resin-coated paper with an air knife coater to adjust the amounts of the emulsion and silica coated to 3.0 g/m$^2$ and 0.5 g/m$^2$, respectively, in terms of dry solids, and dried, whereby a receiving sheet for heat transfer recording was obtained.

Comparative Example 2

A mixture of a polyester resin emulsion (Vylonal MD-1930, Toyobo Co., Ltd.) and silica was coated directly on synthetic paper (Yupo FPG-110, Oji Yuka Co., Ltd.) with an air knife coater to adjust the amounts of the emulsion and silica coated to 3 0 g/m$^2$ and 0 5 g/m$^2$, respectively, in terms of dry solid, and dried, whereby a receiving sheet for heat transfer recording was obtained.

Comparative Example 3

An addition-polymerizable composition according to the recipe shown below was coated on art paper in an amount of 3.0 g/m$^2$ with an offset gravure coater and cured by irradiation with an electron beam (accelerating voltage: 175 KV, irradiation dose: 1 Mrad) to obtain a receiving sheet for heat transfer recording.

| Addition-polymerizable composition | |
|---|---|
| Acrylic oligomer TC-120S (mfd. by Nippon Kayaku Kabushikikaisha) | 50 parts |
| Acrylic monomer M-210 (mfd. by Toagosei Chemical Industry Co., Ltd.) | 50 parts |

EXAMPLE 5

An addition-polymerizable composition consisting of 98 parts of an acrylic monomer M-220 (Toagosei Chemical Industry Co., Ltd.) and 2 parts of benzyl dimethyl ketal (IRGACURE 951, Ciba-Geigy Co.) was coated in an amount of 5.0 g/m$^2$ on a photographic support (a so-called resin coated paper) obtained by laminating a polyethylene on paper. Then, an addition-polymerizable composition consisting of a solution in ethyl acetate of 50 parts of a polyester resin (Vylon 300, Toyobo Co., Ltd.), 49 parts of an acrylic monomer M-220 (Toagosei Chemical Industry Co., Ltd.) and 1 part of benzyl dimethyl ketal (IRGANOCURE 951, Ciba-Geigy Co.) was coated on the coated composition in an amount of 3.0 g/m$^2$ in terms of dry solids with an offset gravure coater, and dried. Thereafter, the compositions were cured by ultraviolet irradiation (three 80 W lamps) to obtain a receiving sheet for heat transfer recording.

EXAMPLE 6

An addition-polymerizable composition consisting of 50 parts of an acrylic oligomer TC-120S (Nippon Kayaku Kabushikikaisha) and 50 parts of an acrylic monomer M-210 (Toagosei Chemical Industry Co., Ltd.) was coated on coat paper in an amount of 3.0 g/m$^2$ with an offset gravure coater and cured by irradiation with an electron beam (accelerating voltage: 175 KV, irradiation dose: 1 Mrad). Thereafter, a solution of 40 parts of a polyester resin (Vylon 300, Toyobo Co., Ltd.) and 60 parts of an acrylic monomer M-210 (Toagosei Chemical Industry Co., Ltd.) in ethyl acetate was coated on the hardened composition to adjust the total amount of the polyester resin and the acrylic monomer coated to 3.0 g/m$^2$ in terms of dry solids. The resulting second coating layer was dried and then cured by irradiation with an electron beam (accelerating voltage: 175 KV, irradiation dose: 1 Mrad), whereby a receiving sheet for heat transfer recording was obtained.

EXAMPLE 7

An addition-polymerizable composition consisting of 95 parts of an acrylic oligomer M-210 (Toagosei Chemical Industry Co., Ltd.) and 5 parts of Syloid 162 (Fuji Devison Co., Ltd.) was coated on synthetic paper (Yupo FPG-110, Oji Yuka Co., Ltd.) in an amount of 2.5 g/m$^2$ with an offset gravure coater and cured by irradiation with an electron beam (accelerating voltage: 150 KV, irradiation dose: 1.5 Mrad). Thereafter, 90 parts of a polyester resin (Vylon 200, Toyobo Co., Ltd.) and 10 parts of an acrylic oligomer M-210 (Toagosei Chemical Industry Co., Ltd.) were coated on the cured composition with an offset gravure coater to adjust the total amount of the polyester resin and the acrylic oligomer coated to 2.5 g/m$^2$ in terms of dry solids. The resulting second coating layer was dried and then cured by irradiation-with an electron beam (accelerating voltage: 150 KV, irradiation dose: 1.5 Mrad), whereby a receiving sheet for heat transfer recording was obtained.

EXAMPLE 8

An addition-polymerizable composition consisting of 95 parts of an acrylic oligomer M-210 (Toagosei Chemical Industry Co., Ltd.) and 5 parts of Syloid 162 (Fuji Devison Co., Ltd.) was coated on art paper in an amount of 2.5 g/m$^2$ with an offset gravure coater and cured by irradiation with an electron beam (accelerating voltage: 150 KV, irradiation dose: 1.5 Mrad). Thereafter, a solution in ethyl acetate of 50 parts of polyester resin (Vylon 300, Toyobo Co. , Ltd. ) , 45 parts of an acrylic oligomer M-210 (Toagosei Chemical Industry Co., Ltd.) and 5 parts of Syloid 162 (Fuji Devison Co., Ltd.) was coated on the hardened composition with an offset gravure coater to adjust the total amount of the polyester resin, the acrylic oligomer and Syloid 162 coated to 3.0 g/m$^2$ in terms of dry solids. The resulting second coating layer was dried and then cured by irradiation with an electron beam (accelerating voltage: 150 KV, irradiation dose: 1.5 Mrad), whereby a receiving sheet for heat transfer recording was obtained.

Comparative Example 4

An addition-polymerizable composition consisting of 50 parts of an acrylic oligomer TC-120S (Nippon Kayaku Kabushikikaisha) and 50 parts of all acrylic monomer M-210 (Toagosei Chemical Industry Co., Ltd.) was coated on synthetic paper (Yupo FPG-110, Oji Yuka Co., Ltd.) in an amount of 3.0 g/m$^2$ with an offset gravure coater and cured by irradiation with an electron beam (accelerating voltage: 175 KV, irradiation dose: 1 Mrad). Thereafter, a solution of 20 parts of a polyester resin (Vylon 200, Toyobo Co., Ltd.) and 80 parts of an acrylic monomer M-210 (Toagosei Chemical Industry Co., Ltd.) in ethyl acetate was coated on the hardened composition to adjust the total amount of the polyester resin and the acrylic monomer coated to 3.0 g/m$^2$ in terms of dry solids. The resulting second coating layer was dried and then cured by irradiation with an electron beam (accelerating voltage: 175 KV, irradiation dose: 1 Mrad), whereby a receiving sheet for heat transfer recording was obtained.

Comparative Example 5

A polyester resin emulsion (Vylonal MD-1330, Toyobo Co., Ltd.) and silica were coated on coat paper with an air knife coater to adjust the amounts of the emusion and silica coated to 3.0 g/m$^2$ and 0.5 g/m$^2$, respectively, in terms of dry solids and dried. Thereafter, a solution of 20 parts of a polyester resin (Vylon 200, Toyobo Co., Ltd.) and 80 parts of an acrylic monomer M-210 (Toagosei Chemical Industry Co., Ltd.) in ethyl acetate was coated thereon to adjust the total amount of the polyester resin and the acrylic monomer coated to 3.0 g/m$^2$ in terms of dry solids. The resulting second coating layer was dried and then cured by irradiation with an electron beam (accelerating voltage: 175 KV, irradiation dose: 1 Mrad), whereby a receiving sheet for heat transfer recording was obtained.

An ink donor sheet was placed on each of the thus obtained receiving sheets for heat transfer recording so as to bring their coated surfaces face to face with each other, and they were heated from the donor sheet side at 180° C. for 5 seconds. The coloring density attained was measured and blocking (the state of fusion of the receiving sheet and the ink film with each other and the heat shrinkage of the receiving sheet) was examined.

The coloring density is expressed in terms of a value obtained by measuring the coloring density of cyan by means of a Macbeth densitometer. As to the blocking, no blocking is expressed by ○ and considerable blocking by X. The results obtained are in Tables 1 and 2.

TABLE 1

| | Coloring density | Blocking |
|---|---|---|
| Example 1 | 1.50 | ○ |
| Example 2 | 1.42 | ○ |
| Example 3 | 1.58 | ○ |
| Example 4 | 1.51 | ○ |
| Comparative Example 1 | 1.50 | X |
| Comparative Example 2 | 1.49 | X |
| Comparative Example 3 | 0.55 | ○ |

TABLE 2

| | Coloring density | Blocking |
|---|---|---|
| Example 5 | 1.82 | ○ |
| Example 6 | 1.80 | ○ |
| Example 7 | 1.92 | ○ |
| Example 8 | 1.81 | ○ |
| Comparative Example 4 | 1.36 | ○ |
| Comparative Example 5 | 1.39 | X |

As shown in Table 1, the incorporation of a cured resin into the intermediate layer prevents the heat shrinkage of the substrate and blocking, and thereby attains formation of an image having a high coloring density. From Table 2, it can be seen that the incorporation of a cured resin also into the ink-receiving layer in an amount of 60 to 10% further improves the coloring density of image.

What is claimed is:

1. A process for producing a receiving sheet for heat transfer recording which comprises the following steps:
   (a) a step of forming an intermediate layer by coating a composition comprising an addition-polymerizable compound on a substrate,
   (b) a step of curing the intermediate layer by irradiation with radiation, and
   (c) a step of forming an ink-receiving layer by coating a composition comprising a thermoplastic resin on the intermediate layer.

2. A process for producing a receiving sheet for heat transfer recording which comprises the following steps:
   (a) a step of forming an intermediate layer by coating a composition comprising an addition-polymerizable compound on a substrate,
   (b) a step of forming an ink-receiving layer by coating a composition comprising a thermoplastic resin on the intermediate layer, and
   (c) a step of curing the intermediate layer by irradiation with radiation.

3. A process for producing a receiving sheet for heat transfer recording which comprises the following steps:
   (a) a step of forming an intermediate layer by coating a composition comprising an addition-polymerizable compound on a substrate,
   (b) a step of forming an ink-receiving layer by coating a composition comprising a thermoplastic resin and an addition-polymerizable compound on the intermediate layer, and
   (c) a step of curing the intermediate layer and the ink-receiving layer by irradiation with radiation.

4. A process for producing a receiving sheet for heat transfer recording which comprises the following steps:
   (a) a step of forming an intermediate layer by coating a composition comprising an addition-polymerizable compound on a substrate,
   (b) a step of curing the intermediate layer by irradiation with radiation,
   (c) a step of forming an ink-receiving layer by coating a composition comprising a thermoplastic resin and an addition-polymerizable compound on the intermediate layer, and
   (d) a step of curing the ink-receiving layer by irradiation with radiation.

* * * * *